US006484649B1

(12) United States Patent
Wang

(10) Patent No.: US 6,484,649 B1
(45) Date of Patent: Nov. 26, 2002

(54) PEDESTAL TABLE

(75) Inventor: Tin-Chou Wang, Tainan Hsien (TW)

(73) Assignee: Hwan Yih Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/932,992

(22) Filed: Aug. 21, 2001

(51) Int. Cl.[7] ..... A47B 3/06
(52) U.S. Cl. ..... 108/158; 108/150
(58) Field of Search ..... 108/150, 153.1, 108/158, 157.1, 159.11, 157.15, 90; 297/451.5, 461; 248/188, 188.1, 188.7, 188.4

(56) References Cited

U.S. PATENT DOCUMENTS 596,217 A * 12/1897 Raoo
1,302,485 A * 4/1919 De Vaughn
3,073,660 A * 1/1963 Schultz
3,153,524 A * 10/1964 Greenfield et al.
3,230,909 A * 1/1966 Watson
3,399,890 A * 9/1968 Galedrige
3,438,342 A * 4/1969 Woolworth et al.
4,043,278 A * 8/1977 Kessler et al.
5,331,905 A * 7/1994 Hammers et al.
5,353,716 A * 10/1994 Wilbert
5,634,411 A * 6/1997 Chasan

FOREIGN PATENT DOCUMENTS

GB 2194612 A * 3/1988

* cited by examiner

*Primary Examiner*—Jose V. Chen
(74) *Attorney, Agent, or Firm*—Rosenberg, Klein & Lee

(57) ABSTRACT

A table includes an upper flat board having the edge folded to join the edge of a lower shaped board. The lower shaped board has lower side strengthening ribs radially extending from a central connecting part. An inner rod is connected to the central connecting part from an upper threaded portion, and connected to a base member from a lower threaded portion. An outer tube is placed around the inner rod with a top abutting the central connecting part. A plastic sleeve is passed into a lower end of the outer tube with the central hole encircling the inner rod, and has a lower end flange interposed between the bottom of the outer tube and the upper side of the base member. Thus, the boards are held at an elevated position by both the inner rod and the outer tube.

1 Claim, 3 Drawing Sheets

PEDESTAL TABLE

BACKGROUND OF THE INVENTION

The present invention relates to a table, and more particularly, to a table, which has a metallic board part for holding things on, and has a relatively simple structure and assembly.

The top board parts of tables are usually made of plastics, wood, and metals. The board part is connected to the upper end of a central supporting leg, and the supporting leg is connected to a base member from the lower end such that the table can be held in a stable manner.

Tables with plastic top board parts are provided for the use of children because they can't hold large weight. Tables with wooden top board parts are more expensive than both metallic and plastic tables, and have to be covered with protective objects such as glass and table cloth otherwise scratches are likely to form on them. In addition, the wooden top parts usually are not smooth enough.

Tables with metallic top board parts are stronger than those with plastic board parts, and smoother and less expensive than those with wooden board parts.

However, the metallic top board part has to be provided with several strengthening ribs, which are connected to the bottom of the top board by means of soldering. And, a sleeve having inner threads are connected to the center of the bottom of the top board, usually by means of soldering in order for the upper end of the supporting leg to be screwed into. The lower end of the supporting leg is connected to a base member also by means of soldering for supporting the top board part on the ground. It is found that the table with the above structure has the following drawbacks:

Firstly, the single supporting leg of the table is screwed into the fixed sleeve from the upper end, so the top board part can't be stably held in position, in other words, the top board part is likely to shake. Secondly, the table will occupy relatively much space, and is very heavy after assembly; therefore it causes problems, and costs more money in packing and transportation.

SUMMARY OF THE INVENTION

Therefore, it is a main object of the present invention to provide a table, which has a metallic top board part, and simple structure, and which can be assembled very easily.

The table of the present invention includes a first metallic shaped board, a second metallic flat board, an inner rod, an outer tube, a plastic sleeve and a base member. The edge of the second flat board is folded to join the edge of the first shaped board, the first board being positioned under the second board. The shaped board has trenches radially extending from a central connecting part thereof. The trenches each has a corresponding strengthening rib on a lower side of the shaped board.

The inner rod is connected to the central connecting part from an upper threaded end, and connected to the base member from a lower threaded end. The outer tube is placed around the inner rod with a top abutting an upper part of the central connecting part; the sleeve is passed into a lower end of the outer tube with a central hole encircling the inner rod, and is provided with a lower end flange interposed between the bottom of the outer tube and the upper side of the base member.

Because the board parts are supported by both the inner rod and the outer tube, they can be held in position more stably.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
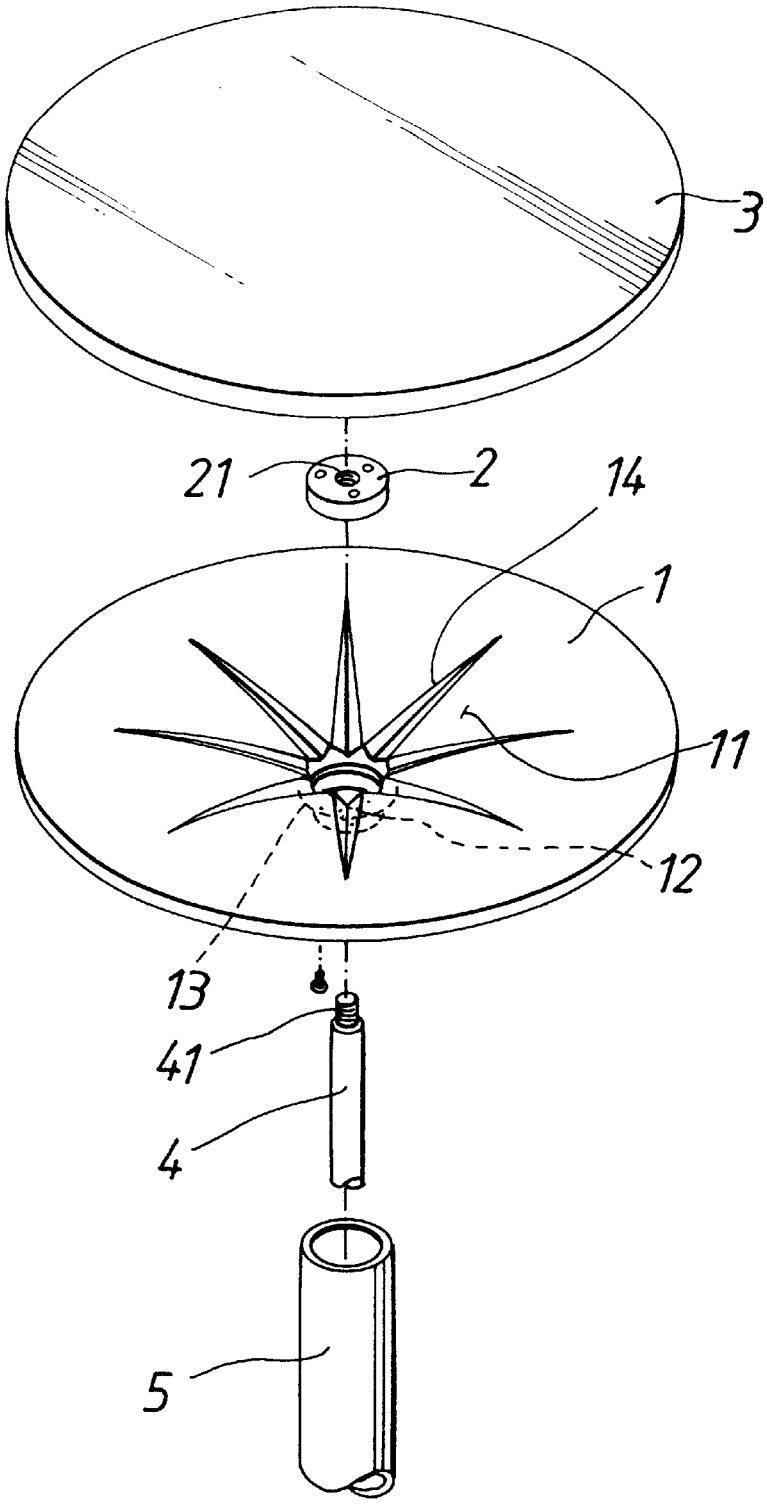
FIG. 1 is a fragmentary exploded perspective view of the table of the present invention.
Figure 2:
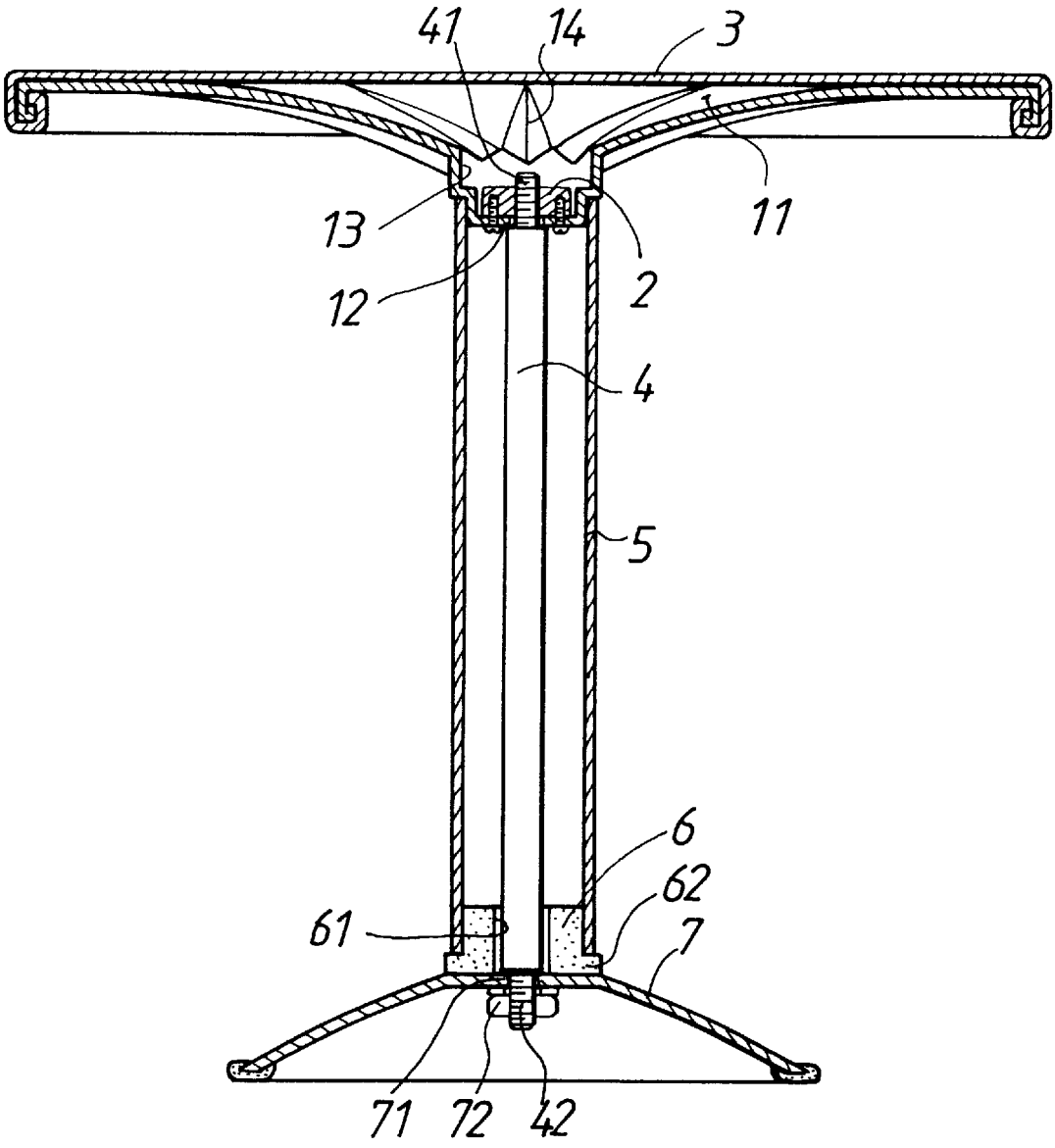
FIG. 2 is a cross-sectional view of the table of the present invention.
Figure 3:
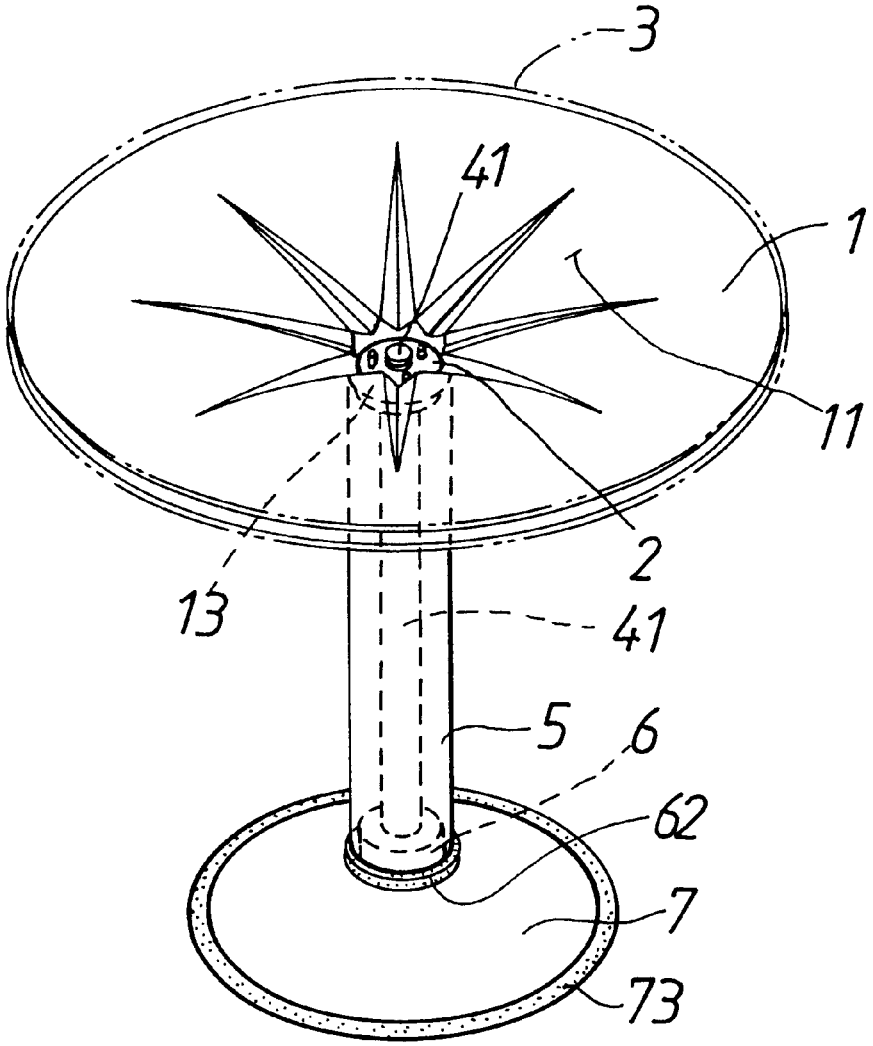
FIG. 3 is a plan view of the table of the present invention.

Referring to FIGS. 1, and 2, a table according to the present invention includes a first shaped board 1, a connecting member 2, a second flat board 3, an inner rod 4, an outer tube 5, a sleeve 6, and a base member 7.

Both the first shaped board 1 and the second flat board 3 are made of metals. The first shaped board 1 has a main body with a depressed area 11 formed between the center and the edge, a central through hole 12 on the main body, and a central connecting part 13, which projects downward from the bottom of the main body and is formed with a central hole aligned with the central through hole 12. The depressed area 11 is formed with a several radially arranged trenches 14 extending from the upper end of the central connecting part 13. The radially arranged trenches 14 can be elongated notches, and each has a corresponding strengthening rib (not numbered) on the bottom of the shaped board 1 for strengthening the shaped board 1. The central connecting part 13 has an upper portion, and a lower portion having a circumference smaller than the upper end; the inner diameter of the upper portion is also bigger than that of the lower portion. The connecting member 2 is shaped such that it can be closely received in the hole of the lower portion of the central connecting member 13; a holding part is formed at the lower end of the lower portion to prevent the connecting member 2 form failing down; screws are used for securing the connecting member 2 to the holding part; the holding part has a central hole aligned with a central screw hole 21 of the connecting member 2.

The second flat board 3 is securely positioned on the top of the first shaped board 1 with the edge being folded to join the edge of the shaped board.

The inner rod 4 has an upper threaded end 41 and a lower threaded end 42; the upper threaded end 41 is screwed into the central screw hole 21 of the connecting member 2 for fixing the inner rod 4 to the first shaped board 1.

The outer tube 5 is positioned under the upper portion of the central connecting part 13 so as to receive the lower portion of the central connecting part 13 and the inner rod 4 therein. The sleeve 6 is made of plastics, and has a lower end flange 62, and a central through hole 61. The sleeve 6 is passed into the lower end of the tube 5 from the upper part with the central through hole 61 encircling a lower part of the inner rod 4, and with the lower flange 62 abutting the bottom of the tube 5; the lower threaded end 42 extends beyond the bottom of the lower flange 62. The flange 62 of the sleeve 6 can be provided with any suitable color as needed.

The base member 7 is shaped to have a receiving room in the lower part; and has a central through hole 71 and a flat part (not numbered) around the central hole 71. The lower threaded end 42 is passed through the central hole 71, and connected to a washer and a nut 72; thus, the sleeve 6 is stably held on the flat part of the base member 7, and the inner rod 4 connects the first shaped board 1 to the base member 7 with the outer tube 5 being also secured in position. The base member 7 is further provided with an antiskid element 73 on the edge of the bottom for preventing the table from skidding on the ground.

In assembly, the first shaped board 1 formed with the strengthening ribs is joined to the second flat board 3 with the edge of the second flat board 3 being folded to join the edge of the first shaped board 1 such that the boards 1, and 3 provide a flat and stable holding surface. Then, the inner rod 4 is screwed into the screw hole 21 of the connecting member 2 fixedly received in the central connecting part 13 of the first shaped board 1 from the upper threaded end 41. The outer tube 5 is placed around the inner rod 4 with the top coming into contact with the bottom of the upper portion of the central connecting part 13 for supporting the boards 1 and 3 at an elevated position. The sleeve 6 is connected to both the inner rod 4 and the outer tube 5. The base member 7 is connected to the lower threaded end 42 of the inner rod 4 with the flange 62 of the sleeve 6 being positioned between the lower end of the outer tube 5 and the upper side of the base member 6.

From the above description, we can easily understand that the table of the present invention has the following desirable features:

1. The structure is relatively simple, therefore the assembly doesn't take much time or labor so as to have relatively low cost.
2. The table can be stably positioned on the ground so as to hold objects on the flat board stably.
3. The flange of the sleeve can prevent the outer tube from rubbing against the upper side of the base member, and help the outer tube to stand on the base member in a secured position. And, the sleeve is available in various colors in order to harmonize with the other parts of the table.

What is claimed is:

1. A table, comprising a first shaped board having a plurality of radially arranged trenches on an upper depressed area; said trenches extending from an upper end of a central connecting part thereof; said trenches each having a corresponding strengthening rib on a lower side of said shaped board; said central connecting member having a central hole, and a holding part formed at a lower end thereof; said holding part having a hole aligned with said central hole;

a connecting member fixedly received in said central connecting part; said connecting member having a screw hole aligned with said central hole of said central connecting part;

a second fiat board positioned on said shaped board with an edge being folded to join an edge of said shaped board;

an inner rod screwed into said screw hole of said connecting member from an upper threaded end; said inner rod having a lower threaded end;

an outer tube placed around said inner rod and said central connecting part of said shaped board; said outer tube having such a length as to allow said lower threaded end of said inner rod to stick out from a lower end thereof;

a plastic sleeve having a central through hole and a flange at a lower end; said sleeve being passed into a lower end of said outer tube with said central through hole encircling said inner rod and said flange being retained on a bottom of said outer tube;

a base member having a receiving room in a lower part and a central hole; said lower threaded end being passed through said central hole of said base member and screwed into a nut to connect said inner rod to said base member; said lower flange of said sleeve being interposed between said bottom of said outer tube and an upper side of said base member.

* * * * *